United States Patent [19]

Page

[11] 3,954,361

[45] May 4, 1976

[54] MELT BLOWING APPARATUS WITH PARALLEL AIR STREAM FIBER ATTENUATION

[75] Inventor: Robert Edward Page, Davis, Ill.

[73] Assignee: Beloit Corporation, Beloit, Wis.

[22] Filed: May 23, 1974

[21] Appl. No.: 472,524

[52] U.S. Cl. ..... 425/72 S; 425/378 R; 425/382 R; 425/464; 264/176 F

[51] Int. Cl.[2] ..... D01D 5/00

[58] Field of Search ..... 425/72, 68, 378 R, 382 R, 425/382.2, 461–467, 376, 380; 264/176 F, 178 F

[56] References Cited

UNITED STATES PATENTS

| | | | |
|---|---|---|---|
| 1,393,144 | 10/1921 | Laskey | 425/72 X |
| 3,379,811 | 4/1968 | Hartmann et al. | 425/72 X |
| 3,543,332 | 12/1970 | Wagner et al. | 425/72 |
| 3,676,242 | 7/1972 | Prentice | 425/72 X |
| 3,825,379 | 7/1974 | Lohkamp et al. | 425/72 |

*Primary Examiner*—Robert L. Spicer, Jr.
*Attorney, Agent, or Firm*—Hill, Gross, Simpson, Van Santen, Steadman, Chiara & Simpson

[57] ABSTRACT

A mechanism and method for producing a plurality of elongate filaments of plastic material from a die head which has a plastic flow chamber for receiving a flow of heated plastic material with the chamber leading to parallel small flow passages having individual tubes extending from the individual passages and having gas flow ducts positioned laterally outwardly of the die head for receiving a flow of heated gas with the ducts directed in a converging direction outwardly of the die head and permitting the opposed streams of gas to merge around the tubes and flow parallel thereto so that a high velocity stream of gas emerges with the plastic and attenuates the plastic stream for strength.

7 Claims, 6 Drawing Figures

Fig. 1
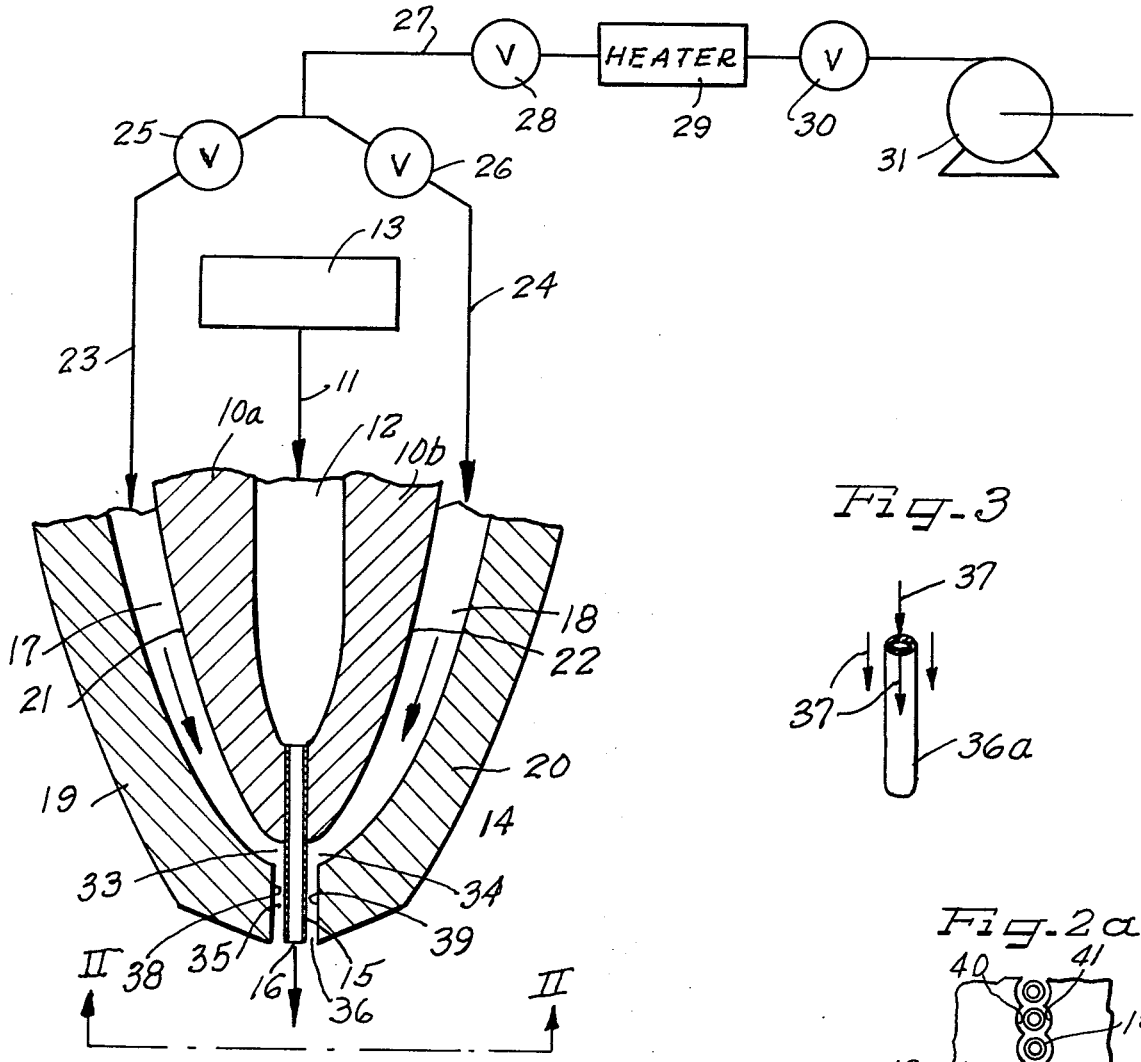
Fig. 3
Fig. 2a
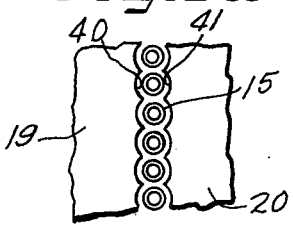
Fig. 2
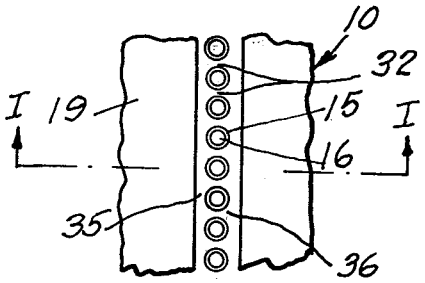
Fig. 2b
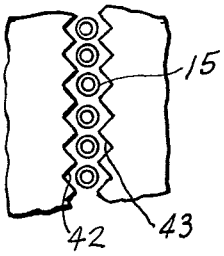
Fig. 2c
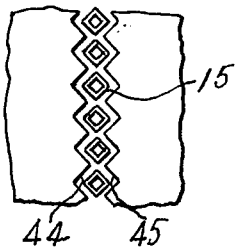

MELT BLOWING APPARATUS WITH PARALLEL AIR STREAM FIBER ATTENUATION

BACKGROUND OF THE INVENTION

The present invention relates to improvements in the art of producing melt-blown microfibers of plastic wherein a plurality of laterally spaced aligned hot melt strands of polymeric material or the like are extruded downwardly and immediately engaged by a pair of heated pressurized angularly colliding heated gas streams.

In typical arrangements heretofore used, the gas streams each were in a flat sheet-like configuration and on opposed sides of each of the strands. The streams functioned to break up the strands into fine filamentous structures attenuating the strands for strength. Examples of constructions of this type are shown in copending applications of Langdon, Ser. No. 463,460 and Daane, Ser. No. 463,459.

In structures such as those shown and disclosed in the above applications, and also in other contemporary developments, two flattened gas streams were employed to laterally engage the fine streams of plastic as they were extruded from the small die openings. Gas temperature, pressure, volume are controlled and maintained uniform for obtaining the optimum effect on the plastic strands. However, difficulties in production caused by nonuniform temperature gradients and problems in elongation occured in certain circumstances and various efforts have been made to correct these difficulties and to improve the quality of the strands formed and the speed of production of the mechanisms and certain improvements are disclosed in the above referred to copending patent applications.

One way of improving the quality of the product produced is to produce a better velocity component of the flow of gas in the direction of the extruded fibers produced by the die. For various reasons, physical limitations are encountered in the relative velocity of the flow of gas. It has been discovered that high velocities approaching or exceeding sonic velocities are desirable. It has also been felt that it is essential to improved product quality and speed of production to obtain a relationship between the gas and plastic flow that obtains optimum contact, both for the attenuation effect of the gas on the plastic and the heat transfer relationship therebetween.

It is accordingly an object of the present invention to provide an improved mechanism and method for producing plastic microfibers which are extruded and engaged with a high velocity flow of gas wherein the gas flow path is controlled relative to the plastic flow to obtain improved product and improved production speed.

More particularly, an object of the invention is to provide a mechanism and method for an improved attenuation effect and improved contact between the flow of gas and flow of plastic in a process embodying blown microfiber production.

A further object of the invention is to provide an improved die head construction incorporating the flow of gas for the production of blown microfibers wherein increased gas velocities can be employed.

A still further object of the invention is to provide an improved extrusion head structure for producing melt-blown microfibers wherein the heat transfer relationship and attenuation relationship between the gas and fibers is improved and wherein the flows are parallel to each other at the point in time of contact therebetween and for the duration of contact.

Other objects, advantages and features, as well as equivalent structures and methods which are intended to be covered herein, will become more apparent with the disclosure of the preferred embodiments in connection with the teachings of the principles of the invention in the specification, claims and drawings, in which:

BRIEF DESCRIPTION OF THE DRAWINGS

FIG. 1 is a vertical sectional view taken substantially along line I—I of FIG. 2;

FIG. 2 is a fragmentary bottom plan view taken substantially along the arrowed lines II—II;

FIGS. 2*a*, 2*b* and 2*c* are fragmentary bottom plan views similar to FIG. 2, but illustrating modified forms of the invention; and FIG. 3 is a greatly enlarged perspective view illustrating the air flow relative to one of the plastic filaments.

DESCRIPTION

As shown in FIGS. 1 and 2, a melt-blown die head 10 is supplied with heated plastic under pressure through a line 11 from a heater and extruder delivery mechanism 13. The head is provided with a supply of plastic and a flow of heated air and ancillary mechanism for providing these materials is described further in the above referred to copending applications and in my copending applications, Ser. No. 427,727 filed Dec. 26, 1973 now U.S. Pat. No. 3,905,734, the drawings and descriptions of which are incorporated herein by reference.

The die head 10 is preferably formed in two mating parts, 10*a* and 10*b* which are fitted together to form a plastic flow chamber 12 therein.

It will be understood that the die head 10 can be formed as a single unit such as by being cast. In a cast construction, the various capillary tubes 15 will be cast into the material of the die head 10. Where the die head is formed of mating parts, the tubes are clamped between the parts 10*a* and 10*b*.

The plastic material flows downwardly and into a plurality of small parallel flow passages 14 which are of the same size and are uniformly spaced from each other, being aligned in a row. The chamber 12 is elongate in a direction transversely of the downward flow of plastic so that a large number of passages 14 are arranged along the bottom of the die chamber 12.

Each off the flow passages 14 has a capillary tube extension 15 through which the plastic material flows to be emitted through an opening 16 at the lower end of each of the tubes. The tubes extend into an air slot 35 to which the air supply is delivered, as will be described in further detail below. The air slot is constructed so that air flow downwardly is oriented in the direction of the flow of the plastic fibers emitting from the tubes, and so that the air flow is substantially in the fibers' axial direction. The tubes extend down with the air slot with the air delivered to the slot in such a manner that the flow essentially surrounds each of the tubes for approaching uniform circumferential distribution around each of the fibers in a manner indicated schematically in FIG. 3, with the fiber represented, and the flow velocity surrounding the fiber indicated by the arrowed vector lines 37 to represent uniform flow at all circumferential locations around the fiber 36a.

In the arrangement of FIG. 1, the side walls of the air slots 35 and 36 are planar at 38 and 39. In the alternate arrangement shown in FIGS. 2*a*, 2*b* and 2*c*, the surfaces of the ducts are shaped to form a plurality of air channels with the distance between the center tubes and the outer walls of the channels being somewhat uniform. This will help insure uniform air flow downwardly around the capillary tubes so that uniform air flow will be emitted around the filament as it emerges from the lower end of the tube. As illustrated in FIG. 2*a*, outwardly from the tubes 15 the inner surfaces 40 and 41 of the air duct walls 19 and 20 are shaped to form undulations. The undulations form grooves or recesses and are concave curved shaped. Preferably they are of a size and shape so that the flow of air around the tubes 15 will be of uniform velocity at all circumferential locations.

In the arrangement of FIG. 2*b*, a modified form of air flow arrangement is provided with the inner surfaces 42 and 43 being V-shaped. The grooves formed by the V-shaped surfaces are in alignment with the tubes 15 so as to form air channels or ducts around each of thee tubes.

In the arrangement of FIG. 2*c*, the inner surfaces 44 and 45 of the air duct walls 19 and 20 are formed in V-shaped grooves or channels. Also, the capillary tubes shown at 15' are rectangular shaped so that their outer surfaces somewhat match the V-shaped channels of the surfaces 44 and 45. This will result in the filaments being rectangular shaped and in a channel around each of the tubes which helps insure a uniform velocity and flow of air downwardly. Also, the outer surfaces of the tubes may be rectangular while the inner surfaces are circular.

Returning now to the air supply arrangement, the nose-piece for the air supply is arranged to essentially enclose the lower portion of the die head 10. The air flow is arranged to flow in downwardly in first and second ducts 17 and 18 which are immediately outwardly of both sides of the die head 10. The ducts are formed by outer air duct walls 19 and 20, and the outer surfaces 21 and 22 of the die head form the inner walls of the air ducts so that good exchange relationship will be maintained between the air and the duct as the air is flowing downwardly. Air is supplied to the two ducts through air conduits 23 and 24, controlled by balancing valves 25 and 26 supplied by a main supply conduit 27. The air is received from a heater 29 and a control valve 28 may be positioned downstream from the heater. A pressurized supply for directing air through the heater is provided by a compressor 31 which may have an output control valve 30. The flow of air is balanced to be delivered at essentially the same velocity through the two ducts 17 and 18 and air is delivered at a sufficient pressure to be emitted down through the slot 35 at high velocities approaching or exceeding sonic velocity. It has been discovered that contrary to limitations experienced in structures which directed the air against the plastic in sheet flow heretofore, velocities in excess of sonic velocities can be utilized in the instant structure embodying the principles of the invention. Improved attenuation of the fibers and improved uniform temperature in the fibers is obtainable by utilizing high velocity flow of air or other gas.

As the sheets of air descend downwardly through the upper parts of the ducts 17 and 18, the air will enter the upper portion of the air slot 35 at 33 and 34 and will surround the tubes 15. Because the air is brought downwardly through the ducts which extend in a converging direction, each of the streams will tend to flow against the outer surface of the tubes and be turned downwardly to flow in a direction parallel to the tube through the throat or gap 35. In the spaces between the tubes, shown at 32 in FIG. 2, the flows will impact on each other and will turn downwardly to flow between the tubes and in contact with the walls thereof in a direction parallel to the tubes downwardly to the throat. Thus, the air will mix uniformly around the tubes to attain uniform velocity throughout the circumference of each of the tubes to be flowing in a surrounding jacket encircling or encompassing the filament of plastic as it emerges from the lower opening 16 of the tube.

Also, the air is maintained in good contact for heat transfer during its flow downwardly over the outer surfaces of the head so that the temperatures of the plastic and the air tend to approach each other as closely as possible and, of course, the input controls for the plastic temperature and heated air maintained for optimum performance. In some instances, a temperature differential may be desired to be maintained between the air and the plastic, and in this instance the effect of the heat of the head will be uniform on the air as it descends, and the heat of the plastic will uniformly heat the tube circumferentially so that the effect on the air surrounding the tube will be uniform and the impact between the air and the plastic filament will be uniform.

An important factor is that the attenuation effect of the air moving at high velocities relative to the plastic filament is uniform for the full circumference of the filament, and the effects of the fricitional resistance of the filament against the air and the pressure of the air against the filament, i.e., the dynamic and static effect of the air relative to the filament will be uniform circumferentially. This obtains a more uniform and more desirable effect between the air and plastic for an improved product. While air is preferred, other forms of gases may be employed.

I claim as my invention:

1. A mechanism for producing a plurality of elongate filaments of plastic material comprising in combination:

a die head having a plastic flow chamber therein for receiving a flow of heated plastic material with said die head being elongate transversely of the direction of plastic material flow;

a plurality of small parallel flow passages in the head leading from said head chamber for conducting plastic therefrom;

individual tubes extending parallel from each of said passages with an extruding discharge opening at their downstream end and receiving plastic material from said passages;

and first and second gas flow ducts positioned laterally outwardly respectively at each side of said elongate die head for receiving gas under pressure, said ducts having a downstream portion outwardly of said tubes and parallel thereto for discharging gas substantially parallel to the plastic flow from the tubes with the gas engaging the outer surface and attenuating the free plastic streams emitted from the discharge openings of the tubes;

said tubes being laterally spaced from each other so that gas in said downstream portion of said ducts encircles the tubes for 360° and flows axially surrounding the tubes encircling the streams for attenuating the streams completely around their outer surfaces.

2. A mechanism for producing a plurality of elongate filaments of plastic material constructed in accordance with claim 1:

wherein the outer surface of said die head forms the inner wall of said ducts to permit heat transfer from the die head to the gas flowing in said ducts.

3. A mechanism for producing a plurality of elongate filaments of plastic material constructed in accordance with claim 1:

including means for heating a supply of gas directed under pressure to said gas flow ducts.

4. A mechanism for producing a plurality of elongate filaments of plastic material constructed in accordance with claim 1:

wherein the downstream end of said gas flow ducts is coterminating with the downstream end of said tube so that the gas engages the streams of plastic immediately as they are emitted from the discharge ends of said tubes.

5. A mechanism for producing a plurality of elongate filaments of plastic material constructed in accordance with claim 1:

wherein said gas flow ducts converge in the direction of their gas flow toward said tubes and merge at the upstream ends of said tubes so that the gas flow in said first and second ducts is united for the length of said tubes.

6. A mechanism for producing a plurality of elongate filaments of plastic material constructed in accordance with claim 1:

wherein the upstream ends of the gas flow ducts outwardly of the die head extend in a converging direction and where the downstream ends turn for the extent of said tubes so that the gas flows are parallel to the tubes.

7. A mechanism for producing a plurality of elongate filaments of plastic material comprising in combination:

a die head having a plastic flow chamber therein for receiving a flow of heated plastic material with said die head having a plurality of small parallel flow passages in the head leading from the head chamber and leading to plastic emission openings through which small streams of plastic are emitted.

said flow passages comprising individual parallel tubes laterally separated from each other;

and gas flow duct means for conducting a flow of heated gas positioned to conduct gas in the path parallel to the direction of flow of said plastic streams and surrounding the tubes upstream of their emisssion openings and surrounding the plastic streams for 360° immediately as they are emitted from the openings and in the same direction as the plastic streams.

* * * * *